United States Patent [19]

Fujihisa et al.

[11] Patent Number: 4,628,288

[45] Date of Patent: Dec. 9, 1986

[54] CIRCUIT INTERRUPTER

[75] Inventors: Hiroaki Fujihisa; Hirotoshi Ohishi, both of Fukuyama; Hiroshi Fujii, Asaguchi County; Yoshiaki Kobayashi, Fukuyama, all of Japan

[73] Assignee: Mitsubishi Denki Kabushiki Kaisha, Tokyo, Japan

[21] Appl. No.: 721,895

[22] Filed: Apr. 11, 1985

[30] Foreign Application Priority Data

May 15, 1984 [JP] Japan ..... 59-99216
May 15, 1984 [JP] Japan ..... 59-99217

[51] Int. Cl.[4] ..... H01H 9/20
[52] U.S. Cl. ..... 335/166; 200/153 G
[58] Field of Search ..... 200/153 G, DIG. 42; 335/166, 167, 171, 172, 175, 190, 191

[56] References Cited

U.S. PATENT DOCUMENTS 3,774,129 11/1973 Sugiyama ..... 335/175 X
4,129,762 12/1978 Bruchet ..... 335/166 X

FOREIGN PATENT DOCUMENTS 1904731 11/1975 Fed. Rep. of Germany .

*Primary Examiner*—J. R. Scott
*Attorney, Agent, or Firm*—Leydig, Voit & Mayer, Ltd.

[57] ABSTRACT

A circuit interrupter comprising a pair of separable contacts at least one of which is movable, and an operating mechanism operatively connected to the movable contacts for opening and closing the contacts. The operating mechanism includes a movable contact arm having mounted thereon the movable contact, a latch lever pivotally mounted on the movable contact arm, and a toggle link mechanism connected at its one end to an operating handle and the other end of which is directly engageable with the movable contact arm and the latch lever. The movable contact arm has a latch surface, and the latch lever has a latching end which, in cooperation with the latch surface, releasably catches the other end of the toggle link mechanism. The movable contact arm further has formed thereon a stop surface for preventing the movement of the other end of the toggle link mechanism beyond the point at which the toggle link mechanism is partly collapsed when the contacts are welded to each other. A roller may be mounted on the other end of the second toggle link for quick and smooth operation of the operating mechanism.

6 Claims, 8 Drawing Figures

CIRCUIT INTERRUPTER

BACKGROUND OF THE INVENTION

This invention relates to circuit interrupters and more particularly to improvements in an operating mechanism of circuit interrupters.

West German Pat. No. 19 04 731 discloses an electric circuit interrupter in which a movable contact arm having a movable contact is pivoted for opening and closing operation of the circuit interrupter, and the movable contact arm has pivotally mounted thereon a releasable member which is acted by an electromagnetic trip device or a bimetallic thermal trip device to be released for a contact opening operation from the latching action of a latch member. The latching member is pivoted on the movable contact arm with its one end being in the latching engagement with the releasable member and another end thereof is pivotally connected to one end of a toggle mechanism. The other end of the toggle mechanism is pivotally connected to a manually operable operating handle.

When an overcurrent flows through the circuit interrupter, the bimetallic element is heated to deflect to such an extent that the free end of the bimetallic element pushes and rotates the releasable member which in turn releases the latch member from its latching position. As a result, the movable contact arm is pivoted to trip open the circuit interrupter. When a massive overload current much greater than the first overcurrent flows through the circuit interrupter, in addition to the above-described opening operation due to the deflection of the bimetal element the electromagnetic trip device generates an electromagnetic force which actuates a magnetic plunger to push and rotate the latch member from its latching position into its tripping position, which causes the contact opening operation of the circuit interrupter. When it is desired to manually operate the circuit interrupter, the operating handle of the interrupter is moved. When the handle is operated, the toggle mechanism bridging between the handle and the latch member transmits the handling movement to the latch member and to the movable contact arm to open pivot and the contact of the circuit interrupter.

While this circuit interrupter is quite satisfactory in so far as its operation is concerned, it is desirable to provide a circuit interrupter having an operating mechanism simpler in structure for opening and closing the circuit interrupter contacts. A simple operating mechanism results in a superior interrupting capability and ease in manufacture due to the reduced number of parts constituting the operating mechanism.

In copending U.S. patent application Ser. No. 689,435 filed by the same assignee of the present invention, a new circuit interrupter is proposed which is simple in structure and has improved interrupting capability. According to that application, a circuit interrupter comprises a pair of separable contacts at least one of which is movable, and an operating mechanism operably connected to the movable contacts for opening and closing the contacts. The operating mechanism includes a movable contact arm having mounted thereon the movable contact, a latch member pivotally mounted on the movable contact arm, and a toggle link mechanism connected at its one end to an operating handle and the other end of which is directly engageable with said movable contact arm and the latch member. The movable contact arm has a latch surface, and the latch member has a latching end which, in cooperation with the latch surface, releasably catches the other end of the toggle link mechanism.

However, when the operating mechanism is tripped by an over current when the contacts are welded to each other for some reason, the latch lever pivots relative to the movable contact arm while the latter is rigidly held in the closed position. This pivoting movement of the latch lever permits the toggle link mechanism to collapse to rotate the operating handle in a position similar to its contact open position. Also, when the operating handle is manually rotated into the contact open position from the contact closed position with the contacts welded to each other, the toggle link mechanism can be collapsed to pull the latching end of the latch lever to separate from the latch surface of the movable contact arm and yet leave the movable contact arm in the closed position due to welding. This may be disadvantageous in that the operating handle can be positioned in the contact open position even when the contacts are actually closed, posing the danger of causing electrical shocks during maintenance and inspection.

SUMMARY OF THE INVENTION

Accordingly, an object of the present invention is to provide a simple circuit interrupter which exhibits a superior interrupting capability and which is capable of accurately indicating the position of the contacts by the position of the operating handle.

With the above object in view, the present invention resides in a circuit interrupter comprising, a pair of separable contacts at least one of which is movable and an operating mechanism operatively connected to the contacts for opening and closing the contacts, the operating mechanism including a movable contact arm having mounted thereon the movable contact, a latch member pivotally mounted on the movable contact arm, and a toggle link mechanism connected at its one end to an operating handle and the other end of which being engageable with the movable contact arm and the latch member. The movable contact arm has a latch surface and the latch lever has a latching end which, in cooperation with the latch surface, releasably catches the other end of the toggle link mechanism, and the movable contact arm further has formed therein a stop surface for preventing the movement of the other end of the toggle link mechanism beyond a point at which the toggle link mechanism is partly collapsed when the contacts are welded to each other.

BRIEF DESCRIPTION OF THE DRAWINGS

The present invention will become more readily apparent from the following detailed description of the preferred embodiments of the invention taken in conjunction with the accompanying drawings, in which.

DESCRIPTION OF THE PREFERRED EMBODIMENTS

Figure 1:
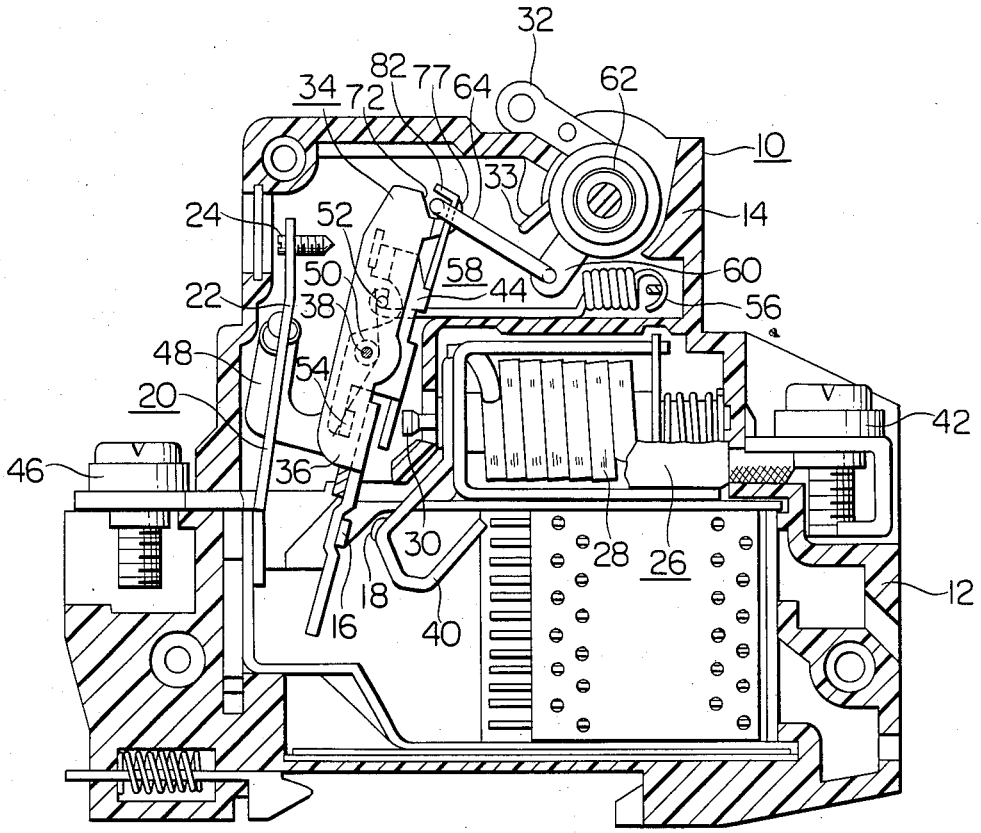
FIG. 1 is a vertical sectional view of a circuit interrupter of one embodiment of the present invention, the circuit interrupter being in the open position.

FIG. 1 shows a circuit interrupter constructed according to the present invention. The circuit interrupter comprises a molded housing 10 formed of a base 12 and a cover 14 each made of an electrically insulating material such as a plastic material. Within the housing 10, a pair of separable contacts 16 and 18, a bimetallic thermal trip device 20 including a bimetallic element 22 and an adjusting screw 24, an electromagnetic trip device 26 including an electromagnetic coil 28 and a plunger 30, an operating handle 32 biased by a torsion spring 33 in the counterclockwise direction in the figure and an operating mechanism 34 having a movable contact arm 36 are disposed.

Contact 16 of the contact pair 16 and 18 is a movable contact, and the other contact 18 is a stationary contact. The movable contact 16 is carried by an end of the movable contact arm 36 pivotally mounted in the housing 10 by a pivot pin 38 so that the pivotal movement of the movable contact arm 36 about the pin 38 causes the movable contact 16 to engage or separate with respect to the stationary contact 18. The stationary contact 18 is supported by a rigid conductor 40 connected to a source side terminal 42 through the coil 28 of the electromagnetic trip device 26 including the plunger 30 which projects from the coil 28 to push a latch member 44 mounted on the movable contact arm 36. The movable contact 16 is connected to a load side terminal 46 through a flexible conductor 48 connected to the contact arm 36 and through the bimetallic element 22 of the thermal trip device 20. Thus, when the contacts 16 and 18 are in contact, an electric current path is provided from the source side terminal 42 to the load side terminal 46 through the coil 28, the rigid conductor 40, the stationary contact 18, the movable contact 16, the movable contact arm 36, the flexible conductor 48 and through the bimetallic element 22.

In accordance with an aspect of the present invention, the movable contact arm 36 of the operating mechanism 34 and the latch member 44 are pivotally supported by the pin 38 fixed on the side walls of the housing 10 and pivotable relative to each other. The pin 38 is wound by a torsion spring 50 which engages at one end thereof with a pin 52 secured on the movable contact arm 36 and at the other end thereof with an extension 54 of the latch member 44. As shown in FIG. 1, the torsion spring 50 biases the latch member 44 to rotate it counterclockwise about the pin 38 with respect to the contact arm 36. The movable contact arm 36 is biased to rotate clockwise as viewed in FIG. 1 by a tension spring 56 mounted between the pin 52 and a pin 57 on the side wall of the housing 10. The operating mechanism 34 further comprises a toggle link mechanism 58 including a first toggle link 60 rigidly and integrally connected at one end to the operating handle 32 which is rotatable about its rotary axis 62 and a second U-shaped toggle link 64 (see FIG. 5) having a first leg or end 66 pivotally connected to the other end of the first toggle link 60. As further seen in FIG. 5, the other latch end 68 of the second toggle link 64 is positioned between "jaws" of the movable contact arm 36 and the latch member 44 or between latch surfaces 72 (FIG. 5) of the latch member 44 and the bent end portion 82 of the latch member 44. Thus, insofar as the other end 68 of the second toggle link 64 is rotatable and caught between the "jaws" of the movable contact arm 36 and the latch member 44, this end 68 of the toggle link mechanism 34 held by the "jaws" may be said to be connected to the movable contact arm 36 and the latch member 44.

Figure 5:
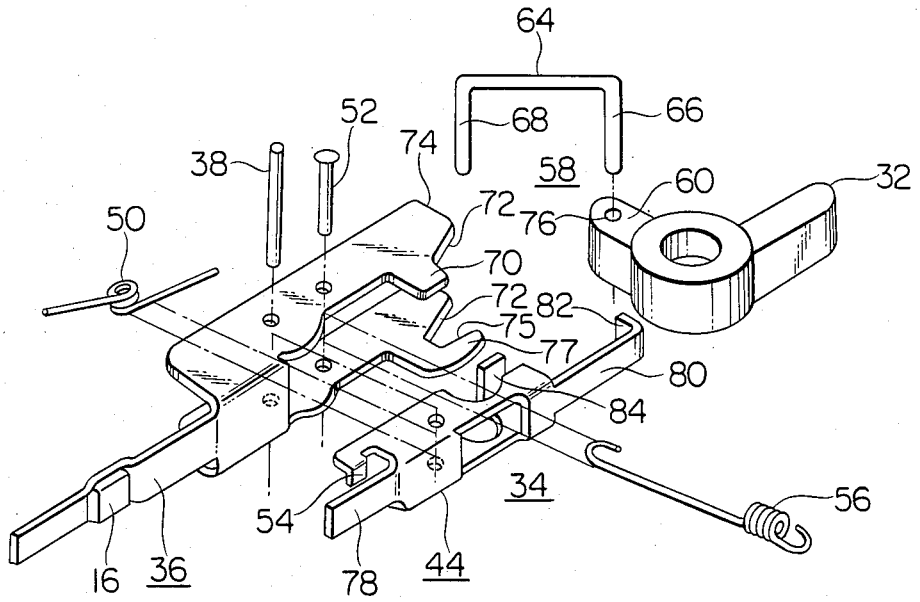
FIG. 5 is an exploded perspective view of the operating mechanism of the circuit interrupter shown in FIGS. 1 to 4.

As is best seen from FIG. 5, in which the components constituting the operating mechanism 34 are illustrated in an exploded perspective view, the movable contact arm 36 is a member made of a bent metallic sheet material including a portion supporting the movable contact 16 and a pair of spaced parallel portions between which the latch member 44 is received. Each of the tips of the parallel portions has formed thereon a stop 70 projecting toward the latch member 44 for engagement with the latch member 44, a latch surface 72 for latching, in cooperation with the tip of the latch member 44, the latch end 68 of the toggle link 64 of the toggle link mechanism 58, and a guide surface 74 for supporting and guiding the latch end 68 of the toggle link 64 of the toggle link mechanism 58.

Figure 4:
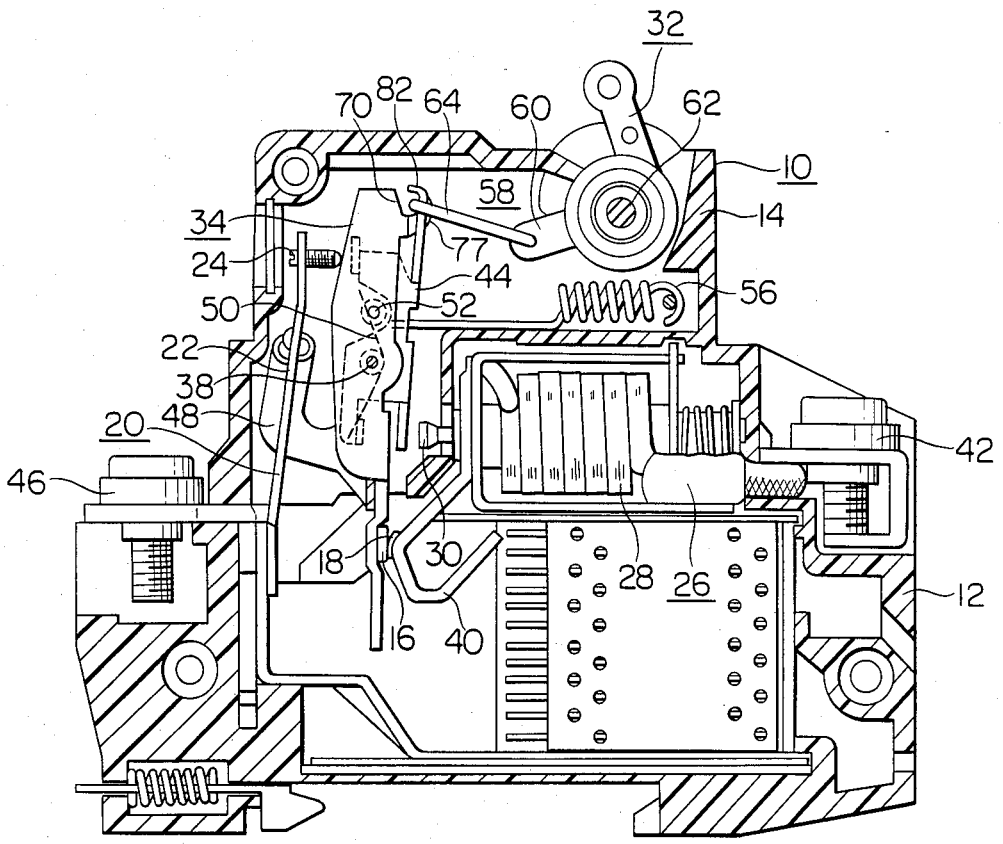
FIG. 4 is a vertical sectional view of the circuit interrupter shown in FIG. 1, the circuit interrupter being in the state in which the operating mechanism including the operating handle is in the open position and the contacts are welded in their closed position.

It is seen that the movable contact arm 36 is further provided with a stop surface 75 defined by an edge of a projection 77 extending from the tip of the stop 70 in the longitudinal direction of the movable contact arm 36. The stop surface 75 substantially opposes the latch surface 72 and is spaced apart from the latch surface 72 so that the other end or the latch end 68 of the toggle link mechanism 58 can be received between the stop surface 75 and the latch surface 72. The position of the stop surface 75 with respect to the latch surface 72 is such that the stop surface 75 prevents the movement of the latch end 68 of the toggle link mechanism 58 beyond a point at which the toggle link mechanism 58 is partly collapsed when the contacts 16 and 18 are welded to each other as shown in FIG. 4.

When assembled, the first end 66 of the second toggle link 64 is rotatably held in a hole 76 formed in the first toggle link 60 which is an integral portion of the operating handle 32, and the second latch end 68 is placed against the latch surface 72 of the movable contact arm 36.

The latch member 44 also is a bent metallic sheet member adapted to be received between the pair of spaced, parallel portions of the contact arm 36. The latch member 44 has a tongue 78 at which the plunger 30 of the electromagnetic trip device 26 makes contact when activated, an elongated L-shaped latch 80 including a bent tip 82 and a tab 84 adapted to be pushed by the adjusting screw 24 of the bimetallic trip device 20. In the assembled state shown in FIG. 1, the latch member 44 is biased by the torsion spring 50, which engages the pin 52 on the contact arm 36 and the extension 54 of the latch member 44, and the elongated latch 80 is pressed against the stops 70 of the movable contact arm 36. It is to be noted that the bent end 82 of the latch member 44, the strength of the torsion spring 50, and the configuration of the latch face 72 are so selected that the second latch end 68 of the second toggle link 64 is caught between the bent tip 82 of the latch member 44 and the edges 70 and 72 of the movable contact arm 36 when the circuit interrupter is in the closed position as shown in FIG. 2.

Figure 2:
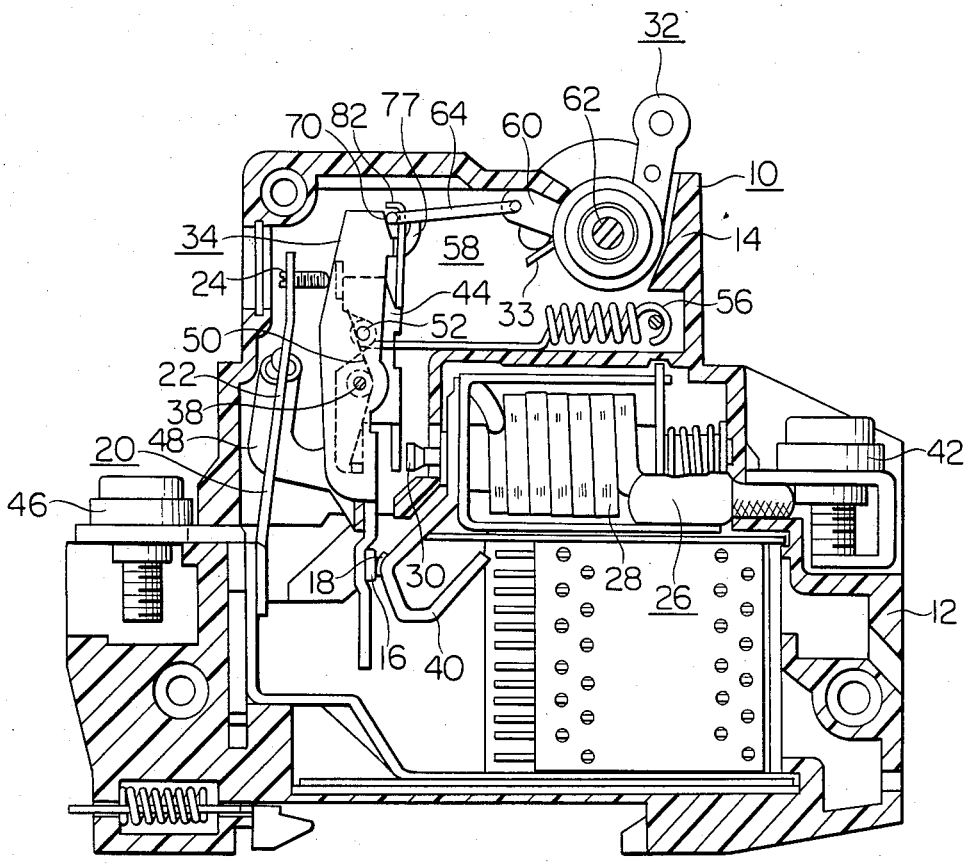
FIG. 2 is a vertical sectional view of the circuit interrupter shown in FIG. 1, the circuit interrupter being in the closed position.

In operation, the circuit interruption may be manually brought into closed position as shown in FIG. 2 by turning the operating handle 32 into the ON position shwon in FIG. 2 from the OFF position shown in FIG. 1. The clockwise rotation of the handle 32 against the action of the spring 56 causes the second latch end 68 of the second toggle link 64 to push the edges or the latch surfaces 72 (FIG. 5) of the movable contact arm 36 to rotate the movable contact arm 36 about the pin 38 in the counter-clockwise direction against the action of the spring 56, thereby causing the movable contact 16 to engage with the stationary contact 18 as shown in FIG. 2. During this movement of the movable contact arm 36, a toggle knee point, which is on the first end 66 of the second toggle link 64 pivotally inserted into the first toggle link element 60 on the handle 32, moves across the center of the action of the toggle link mechanism 58 and the toggle knee point or the first end 66 of the second link 64 is pushed against the top wall of the cover 14 of the housing 10, whereby the toggle mechanism 58 and therefore the operating mechanism 34 is locked in this closed position.

Figure 3:
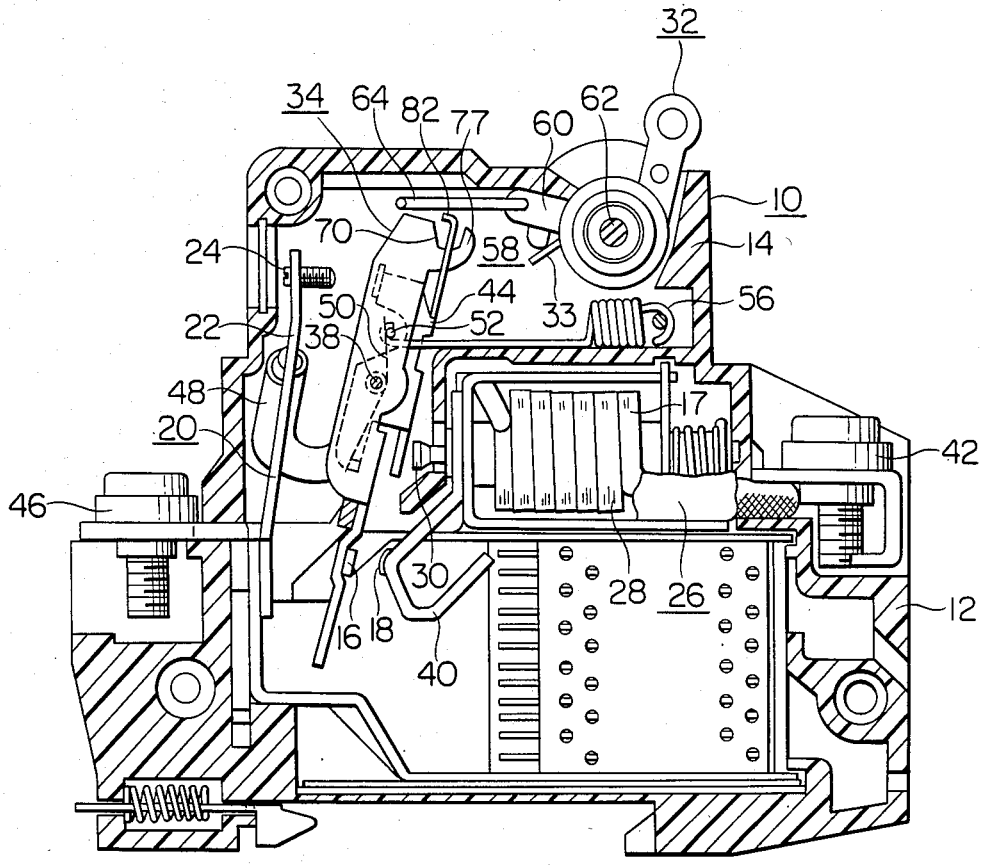
FIG. 3 is a vertical sectional view of the circuit interrupter shown in FIG. 1, the circuit interrupter being in the state immediately after tripped open.

When an overcurrent of a relatively low level flows through the circuit interrupter in the contact closed position (FIG. 2), the thermal trip device 20 is actuated to push the tab 84 on the latch member 44 against the action of the torsion spring 50 to rotate clockwise the latch member 44 relative to the movable contact arm 36. This rotation of the latch member 44 causes the "jaw" of the latch mechanism 34 or the engaging surfaces 70, 72 of the contact arm 36 and the bent end 82 of the latch member 44 to open to release the second latch end 68 of the second toggle link element 64. Therefore, the toggle link second latch end 68 is allowed to slip out from the "jaw" to allow the movable contact arm 36 to be released under the action of the tension spring 56 which causes the clockwise rotation of the movable contact arm 36 and the latch member 44 due to the spring 56, whereby the movable contact 16 separates from the stationary contact 18 as illustrated in FIG. 3 to interrupt the overcurrent. Immediately after the toggle link 64 is released and the contacts 16 and 18 are opened as shown in FIG. 3, the operating handle 32 rotates counterclockwise due to the torsion spring 33. This rotation of the handle 32 causes the second end 68 of the toggle link 64 to be inserted into the "jaw" or the space between the engaging surfaces 70 and 72 of the movable contact arm 36 and the bent end portion 82 of the latch member 44, thus returning to the contact open position shown in FIG. 1. During this operation, the stop surface 75 or the projection 77 does not impede the movement of the second end 68 of the toggle link 64 relative to the "jaws" since they extend in the longitudinal direction with respect to the movable contact arm 36.

When a very severe overcurrent flows through the circuit interrupter in the closed position shown in FIG. 2, the plunger 30 of the electromagnetic trip device 26 instantaneously projects from the coil 28 due to the electromagnetic force generated by the overcurrent. The plunger 30 thus pushes the tongue 78 of the latch member 44 to rotate the latch member 44 clockwise about the pin 38 with respect to the movable contact arm 36 against the action of the torsion spring 50. This clockwise rotation of the latch member 44 causes the operating mechanism 34 of the circuit interrupter to achieve the same trip operation as discussed above in conjunction with the relatively low overcurrent condition to interrupt the current flowing through the circuit interrupter.

Sometimes, the movable and stationary contacts 16 and 18 become welded to each other and cannot be opened. In FIG. 2, when an overcurrent flows through the circuit interrupter under such circumstances, the electromagnetic trip device 26 or the thermal trip device 20 actuates the latch lever 44 to rotate clockwise about the pin 38. Thus, the latch end 82 of the latch lever 44 is moved away from the latch surfaces 72 of the movable contact arm 36 since the movable contact arm 36 cannot be rotated in clockwise as shown in FIG. 4. Therefore, due to the operating handle 32 which is biased in the counterclockwise direction by the torsion spring 33, the second end 68 of the toggle link meahcnism 58 is permitted to move in the right as viewed in FIG. 4. However, the stop surface 75 (FIG. 5) of the projection 77 of the movable contact arm 36 acts as a stop for preventing further movement of the second end 68 in the right as viewed in FIG. 4 beyond the illustrated position at which the second end 68 engages the stop surface 75, thus preventing the toggle link mechanism 58 from completely collapsing to rotate the operating handle 32 in the counterclockwise direction from the closed position to the open position and holding the toggle link mechanism 58 and the operating handle 36 in the position illustrated in FIG. 4 in which the operating handle 32 is positioned about midway between the contact open position shown in FIG. 1 and the contact closed position shown in FIG. 2. It is seen that the toggle link mechanism 58 is partly collapsed in this position shown in FIG. 4.

Figure 6:
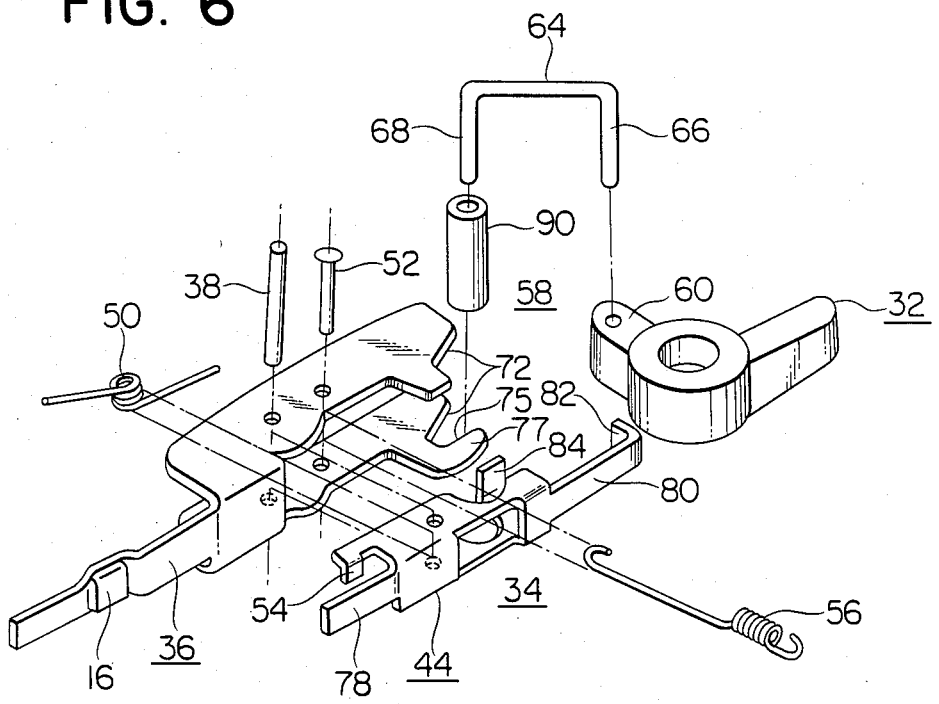
FIG. 6 is an explosed perspective view of the operating mechanism of another embodiment of the present invention.

FIG. 6 illustrates another embodiment of the operating mechanism of the circuit interrupter of the present invention. In this embodiment, it is to be noted that a roller 90 is rotatably mounted on the second end 68 of the second toggle link 64 of the toggle link mechanism 58. In other respect, the structure is the same as that described above in conjunction with the embodiment shown in FIGS. 1 to 5. The roller 90 engages at its cylindrical surface with the bent end portion 82 of the latch member 44 as well as the engaging surfaces 70 and 72 of the movable contact arm 36. According to this embodiment, since the roller 90 is provided on the second end 68 which engages and slides on the bent end 82 of the latch member 44 and the engaging surfaces 70 and 72, the second end 68 can be smoothly and more quickly slides on the surfaces 70 and 72 to be more quickly and reliably released from the "jaw" when the operating mechanism 34 is tripped open.

Figure 7:
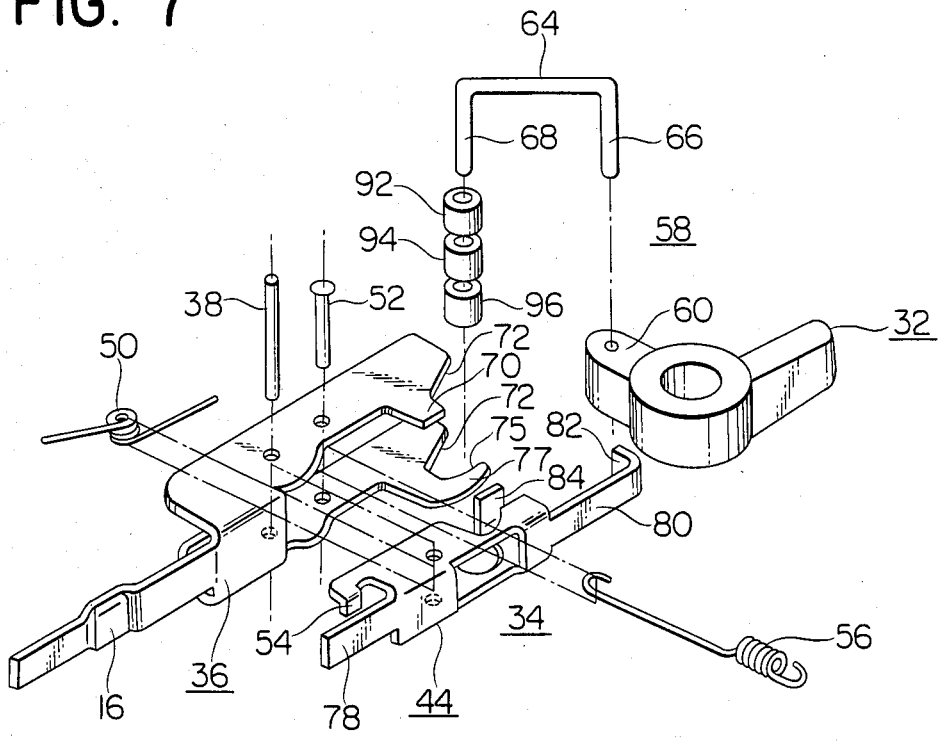
FIG. 7 is an exploded perspective view of the operating mechanism of another embodiment of the present invention.

FIG. 7 illustrates another modification of the operating mechanism of the circuit interrupter of the present invention. It is seen that the second end 68 of the second toggle link 64 is provided with three rollers 92, 94 and 96 which are independently rotatable on the second end 68 of the toggle link 64. The rollers 92 and 96 disposed at the opposite sides (upper and lower rollers in FIG. 7) engages the engaging surfaces 70 and 72 of the upper and the lower (as viewed in FIG. 7) plate sections of the movable contact arm 36, respectively. Since the bent end portion 82 is narrower than the distance between the upper and the lower plate sections, it does not engage the roller 92 or 96. The central roller 94 engages the bent end portion 82 of the latch member 44, and it does not engage with the engaging surfaces 70 and 72. When the second end 68 of the toggle link 64 is to be released from the space between the movable contact arm 36 and the latch member 44, three rollers 92, 94 and 96 are rotated in the opposite directions independently of each other according to the side of the rollers on which the engaging surfaces 70 and 72 and the bent end portion 82 engage. Thus, three rollers 92, 94 and 96 realizes still quicker, smoother and reliable tripping operation of the operating mechanism.

Figure 8:
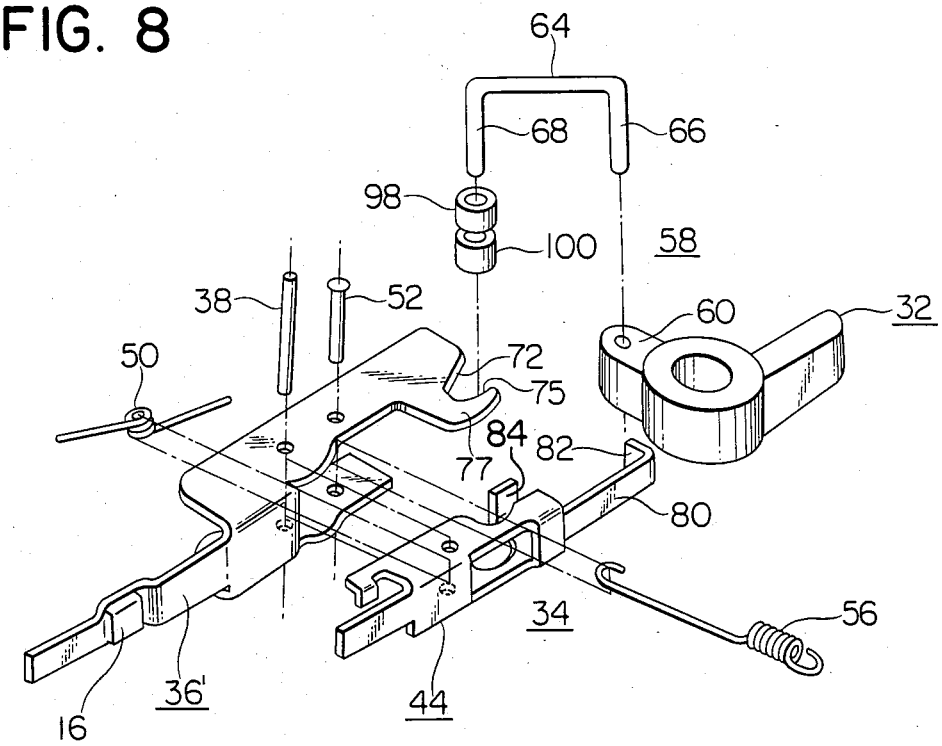
FIG. 8 is an exploded perspective view of the operating mechanism of still another embodiment of the present invention.

FIG. 8 illustrates still another embodiment of the operating mechanism 34 in which the second end 68 of the second toggle link 64 is provided with two rollers 98 and 100 independently rotatable on the second end 68. It is also seen that the movable contact arm 36' has only one plate section and only one latch surface 72 with which the second end 68 of the toggle link 64 engages. Thus, the roller 98 (the upper roller in FIG. 8) engages the movable contact arm 36' at the engaging surfaces 70 and 72, while the roller 100 (the lower roller in FIG. 8) engages the bent end portion 82 of the latch member 44. This arrangement is simpler in construction and is still quicker and reliable in operation.

What is claimed is:

1. A circuit interrupter comprising:

a pair of separable contacts, at least one of which is movable;

an operating handle for manually operating said interrupter; and an operating mechanism operatively connected to move the movable contact relative to the other contact for opening and closing said circuit interrupter;

said operating mechanism including:

a movable contact arm carrying the movable contact at one end and providing a latch surface at the other end;

a latch member pivotally mounted on said movable contact arm and having a latching end spaced from said latch surface to form a jaw therebetween;

a toggle link mechanism connected at one end to an operating handle and at the other end with said movable contact arm and said latch member, said toggle link mechanism including a first link connected to said operating handle and a second link pivotally connected to said first link at one end and having roller means rotatably mounted on the other end thereof, said mechanism having an extended position corresponding to an open contact position of said handle and a collapsed position corresponding to a closed contact position of said handle, said second link being adapted to be received and held in said jaws by engagement with said latching end and said latching surface to operate said movable contact arm to manually open and close said contacts by said interrupter upon movement of said handle between open and closed positions, said roller means being slidably released from said jaw by coaction with said latch surface upon movement of said latching end away from said latch surface caused by movement of said operating mechanism to the collapsed position to trip said interrupter; and means on said movable contact arm providing a stop surface for preventing the movement of said other end of said toggle link mechanism beyond the point at which said toggle link mechanism is partly collapsed when said contacts are welded to each other.

2. A circuit interrupter as claimed in claim 1 wherein said stop surface substantially faces and is spaced apart from said latch surface for receiving therebetween said other end of said toggle link mechanism.

3. A circuit interrupter as claimed in claim 1 wherein said second link comprises a substantially U-shaped rod having an end leg for mounting said roller means.

4. A circuit interrupter as claimed in claim 1 wherein said roller means on said other end of said second link includes a roller.

5. A circuit interrupter as claimed in claim 1 wherein said movable contact arm has two latch surfaces spaced apart by a distance greater than the width of said latching end of said latch member, and said roller means on said other end of said link includes three independently rotatable rollers, each of said rollers being engageable with the respective one of said latching surfaces and said latching end.

6. A circuit interrupter as claimed in claim 1 wherein said movable contact arm has a single latch surface facing away from said latching end of said latch member, and said roller means on said other end of said second link includes two independently rotatable rollers, each of said rollers being engageable with a respective one of said single latching surface and said latching end.

* * * * *